United States Patent [19]

Kimura

[11] Patent Number: 4,683,463

[45] **Date of Patent: * Jul. 28, 1987**

[54] GAS AND FIRE ALARM AND CONTROL SYSTEM FOR SEMICONDUCTOR FACTORIES OR THE LIKE

[75] Inventor: Shoichi Kimura, Tokyo, Japan

[73] Assignee: Nohmi Bosai Kogyo Co., Ltd., Tokyo, Japan

[ * ] Notice: The portion of the term of this patent subsequent to Mar. 17, 2004 has been disclaimed.

[21] Appl. No.: 914,529

[22] Filed: Oct. 3, 1986

Related U.S. Application Data

[63] Continuation of Ser. No. 581,972, Feb. 21, 1984, abandoned.

[51] Int. Cl.[4] ..... G08B 17/10

[52] U.S. Cl. ..... 340/629; 340/634; 427/86

[58] Field of Search ..... 340/629, 630, 632, 634; 422/98; 436/3; 427/86; 338/34

[56] References Cited

U.S. PATENT DOCUMENTS

| | | | |
|---|---|---|---|
| 4,069,018 | 1/1978 | Karna et al. | 340/632 X |
| 4,088,986 | 5/1978 | Boucher | 340/634 X |
| 4,316,184 | 2/1982 | Nagel | 340/629 X |
| 4,369,031 | 1/1983 | Goldman et al. | 427/85 X |

FOREIGN PATENT DOCUMENTS

| | | | |
|---|---|---|---|
| 611204 | 12/1960 | Canada | 340/632 |

*Primary Examiner*—James L. Rowland
*Assistant Examiner*—Brian R. Tumm
*Attorney, Agent, or Firm*—Nies, Webner, Kurz & Bergert

[57] ABSTRACT

An alarm and control system for semiconductor factories or the like includes, at locations where poisonous and inflammable gases such as silane gas are used as in the manufacturing process of semiconductors, gas detectors to detect the leakage of the treatment gases and fire detectors to detect products of combustion of the treatment gases, and these detectors are adapted to cause, upon any changes in the output state of either of them, an alarm to issue and a protection device such as a fire distinguishing device as well as the manufacturing process to be controlled.

3 Claims, 3 Drawing Figures

GAS AND FIRE ALARM AND CONTROL SYSTEM FOR SEMICONDUCTOR FACTORIES OR THE LIKE

This application is a continuation of application Ser. No. 581,972, filed Feb. 21, 1984, now abandoned.

BACKGROUND OF THE INVENTION

The present invention relates to an alarm and control system, and more particularly to an alarm and control system in semiconductor factories or the like which can detect a fire or the leakage of treatment gases which are generated during the manufacturing process in a very large-scale integration (LSI) factory and which also suitably controls the manufacturing process as well as a protection device such as fire extinguishing equipment.

In semiconductor factories for LSI's, etc. at the time of applying an isolation film to a silicon wafer a silane gas is utilized. Such a treatment gas is dangerous not only because it is poisonous, but also because when the concentration of the gas becomes 2 to 5% or more it reacts with oxygen in the air and burns. In fact, a fire which occurred in a certain LSI factory and brought about enormous losses was possibly caused by leakage of this gas.

SUMMARY OF THE INVENTION

It is a principal object of the present invention to provide an alarm and control system for semiconductor factories or the like which can detect leaked treatment gas by detecting either the gas itself or products of combustion due to reaction of the gas with oxygen in the air so that an appropriate control can be carried out either before the occurrence of or at the initial stages of a fire.

In an alarm and control system in accordance with the present invention for semiconductor factories or the like where poisonous and inflammable treatment gases such as silane gas are used, gas detecting means to detect the leakage of the treatment gases and fire detecting means to detect products of combustion of the treatment gases are provided at the locations where the poisonous and inflammable gases are used.

The gas detecting means and the fire detecting means cause an alarm to issue and cause a protection device such as a fire extinguishing device as well as the manufacturing process of the semiconductors to be controlled upon any change in the output state of either the gas detecting means or the fire detecting means from their normal output states.

BRIEF DESCRIPTION OF THE DRAWINGS

This and other objects of the present invention will become more readily apparent upon reading the following description and upon reference to the accompanying drawings, in which.

DESCRIPTION OF THE PREFERRED EMBODIMENT

Figure 1:
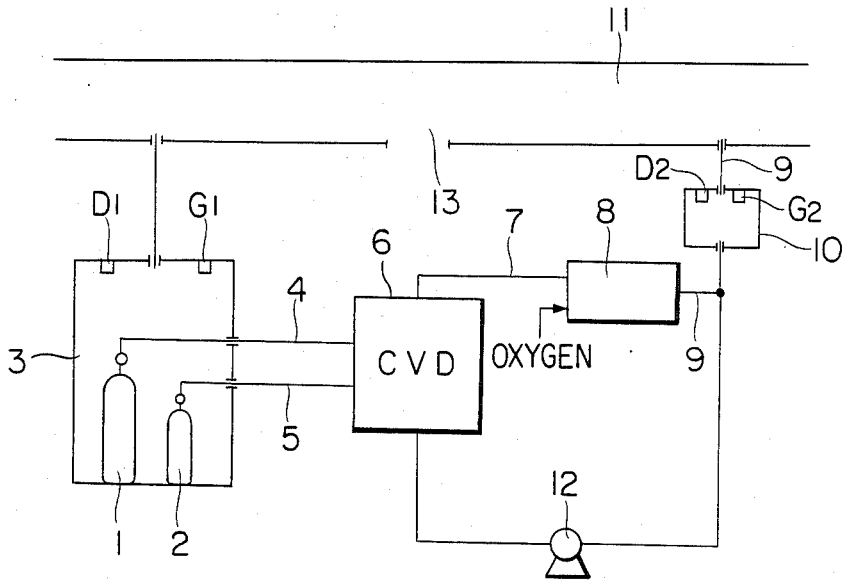
FIG. 1 is a schematic view of one embodiment of the present invention.

Reference is now made to FIG. 1 of the attached drawings wherein is shown one embodiment of the present invention as utilized in a CVD (Chemical Vapor Deposition) apparatus as well as associated apparatuses used at the time of applying an insulation film to a semiconductor wafer.

In FIG. 1, element number 1 is a silane gas cylinder, 2 is an ammonia gas cylinder, 3 is a housing to house these cylinders, 6 is a nitride film-forming device (CVD) to form an insulating film on a semiconductor wafer by supplying silane and ammonia gases through pipes 4 and 5, respectively, 8 is a scavenging device which forcedly oxidizes, i.e. treats by combustion, the unreacted silane gas discharged from the device 6 through a pipe 7 with oxygen being supplied to the scavenging device, from which the treated silane gas is passed through a pipe system 9 to an exhaust duct 11. Component 10 is a detection box provided in the pipe system 9 to monitor the state of the gas to be discharged to an exhaust duct 11 from the scavenging device 8. Unit 12 is a vacuum pump to make the CVD 6 vacuous, and 13 is an exhaust vent into duct 11 from the room where the apparatuses are housed. The housing 3 and the detection box 10 are provided with gas detectors $G_1$ and $G_2$, respectively, to detect the leakage of the treatment gases such as silane gas. Housing 3 and detector box 10 are also provided with fire detectors $D_1$ and $D_2$, respectively, to detect the products of combustion from the burning of the gases. As gas detectors $G_1$, $G_2$, a photoelectric-type gas detector in which the light dispersed by the gas particles is detected can be used.

Figure 2:
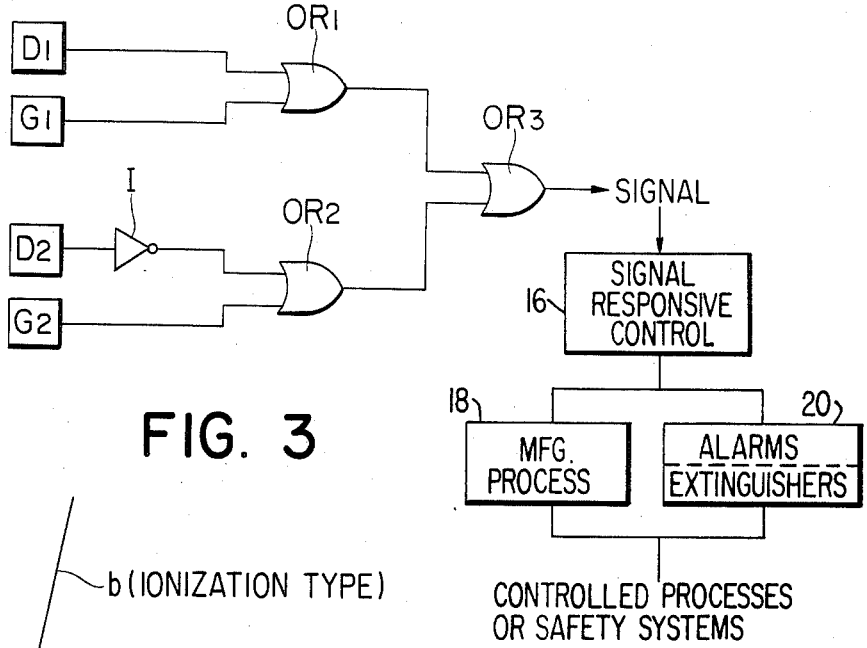
FIG. 2 is a circuit diagram of the embodiment shown in FIG. 1.
Figure 3:
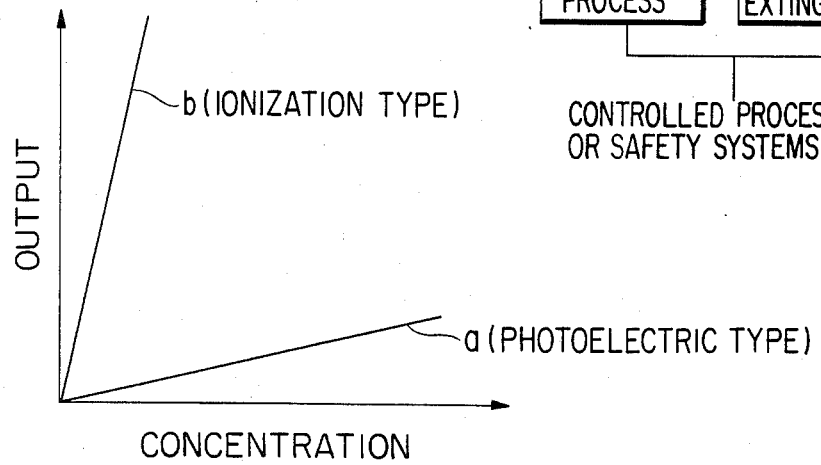
FIG. 3 is the characteristic curves of a photoelectric-type smoke detector and an ionization-type smoke detector.

However, the gas detector used in the present embodiment is preferably one comprising a CO detecting element such as disclosed in Japanese Patent Publication No. 14380/1980 after the element has been aged in an atmosphere of silane gas. The CO detecting element according to that invention is a metal oxide semiconductor containing platinum black in a stannic oxide composition. When aged in an atmosphere of silane gas, it can respond to a concentration of silane gas as low as 0.2 to 0.6%, and is therefore most suitable for use as a gas detector in the present invention. As the fire detector to detect the products of combustion, a photoelectric or ionization-type smoke detector can be utilized. However, judging from the characteristic curves shown in FIG. 3 wherein the outputs of these detectors and the concentration of the combustion products of the silane gas are illustrated as the ordinate and the abscissa, respectively, the ionization smoke detector (b) is more effective than the photoelectric-type smoke detector (a) in detecting the products of combustion of the silane gas, the former detecting the generation of the products of combustion earlier than the latter. As shown in FIG. 2, gas detector $G_1$ and fire detector $D_1$ provided in the housing 3 are connected to a first OR-circuit $OR_1$, and gas detector $G_2$ and fire detector $D_2$ provided in the detection box 10 are connected directly and through an inverter I, respectively, to a second OR-circuit $OR_2$. The outputs of $OR_1$ and $OR_2$ are connected to a third OR-circuit $OR_3$, and the output of $OR_3$ is connected to a relay means controls unit 16 which appropriately controls the manufacturing process 18 of the semiconductor or a device 20 for prevention of disasters such as a fire alarm or a fire extinguishing device, shown as diagrammatic blocks in FIG. 2.

Operation of the apparatus described above is as follows.

The nitride film-forming (CVD) device 6 has semiconductor wafers contained therein, and after it is made vacuous by the vacuum pump 12, the silane and ammonia gas cylinders 1 and 2 are opened to supply the silane and ammonia gases to the device 6, whereby nitride films necessary for the semiconductor wafers, i.e. insulating films are generated thereon. The gases which contain the unreacted gases after the treatment are forcibly oxidized in the scavenging device 8 and discharged into the exhaust duct 11 through the pipe system 9 as a harmless gas.

In this state, should silane gas leak from the silane gas cylinder 1 in an amount that is of a degree insufficient to react with oxygen in the air and burn, the gas detector $G_1$ operates to detect the gas itself. If a large amount of silane gas leaks from the silane gas cylinder 1, and the gas promptly reacts with the oxygen in the air and burns, the fire detector $D_1$ detects the products of combustion and operates. In either case, a control means 16 is operated through the OR-circuits, i.e. $OR_1$ and $OR_3$ and controls a device 18 and/or 20 for prevention of disasters such as a fire alarm, a fire extinguishing device or the manufacturing process. As to the detection box 10, during normal operation of the scavenging device 8, the burnt out products of combustion are discharged to the exhaust duct 11 through the pipe 9. Therefore, neither the gas detector $G_2$ nor the fire detector $D_2$ operates the OR-circuit $OR_2$ because of operation of the inverter I. Should the silane gas be discharged without being treated due to trouble in the scanvenging device 8, either the gas detector $G_2$ or the fire detector $D_2$, through the operation of the inverter I, operates the OR-circuit $OR_2$, so that a relay means 16 is operated which controls either the manufacturing process 18 or a device 20 for prevention of disasters such as a fire alarm, a fire extinguishing device, or the like.

Although in the above embodiment the gas detector and the smoke detector are separately provided, the two detectors may be integrally constituted and the circuit shown in FIG. 2 may be incorporated with them.

As stated above, in an alarm and control system for semiconductor factories or the like according to the present invention gas detectors to detect leakage of treatment gases themselves and fire detectors to detect the products of combustion resulting from combustion of the gases are provided at locations where poisonous and inflammable treatment gases are used so that leakage of the gases can be dealt with, allowing an appropriate control before or at the early stages of a fire.

Although a single preferred embodiment of the present invention has been described above and illustrated herein, it should be understood that various changes and modifications in form and arrangement of parts may be made without departing from the spirit and scope of the present invention.

What is claimed is:

1. An alarm and control system for semiconductor factories or the like having an exhaust system wherein treatment gases including silane gas are used in the manufacturing process of semiconductors, comprising: gas detecting means to detect the leakage of said treatment gases including silane gas, and fire detecting means to detect products of combustion of said treatment gases, which include silane gas, provided at locations where said treatment gases, including silane gas, are used; said fire detecting means consisting of an ionization-type smoke detector; said gas detecting means, provided at the locations where said treatment gases are used, utilize a metal oxide semiconductor containing platinum black as a detecting element for detecting the leakage of said treatment gases, including silane gas, and any said metal oxide semiconductor used as said detecting element, which contains said platinum black, is aged in an atmosphere of silane gas; said gas detecting means and said fire detecting means having circuitry means which, upon a change in the output stage of either of said metal oxide semiconductor or said fire detecting means, causes an alarm signal to issue; and means responsive to said alarm signal connected to control a protection device such as a fire extinguishing device as well as said manufacturing process of semiconductors or the like.

2. An alarm and control system for semiconductor factories or the like as claimed in claim 1 wherein said fire detecting means includes circuitry with inverters provided at its output and said gas detecting means is installed in said exhaust system.

3. An alarm and control system for semiconductor factories or the like as claimed in claim 1 wherein a housing is provided wherein cylinders of treatment gases including silane gas are housed, and said gas detecting means and said fire detecting means are installed in said housing.

* * * * *